United States Patent [19]

Cuzzone

[11] 4,060,786

[45] Nov. 29, 1977

[54] ELECTRIC FUSE WITH SEALED INDICATOR

[75] Inventor: Raymond Cuzzone, Pittsfield, Mass.

[73] Assignee: General Electric Company, Philadelphia, Pa.

[21] Appl. No.: 735,184

[22] Filed: Oct. 26, 1976

[51] Int. Cl.[2] ..... H01H 85/30

[52] U.S. Cl. ..... 337/244; 337/248

[58] Field of Search ..... 37/244, 241, 248, 267; 340/250; 200/308; 116/114.5

[56] References Cited

U.S. PATENT DOCUMENTS

| | | | |
|---|---|---|---|
| 3,636,491 | 1/1972 | Cameron | 337/244 |
| 3,895,338 | 7/1975 | Gray et al. | 337/244 |

*Primary Examiner*—Harold Broome

*Attorney, Agent, or Firm*—Francis X. Doyle; William Freedman

[57] ABSTRACT

A current-limiting power fuse has an indicator mechanism which includes a conductive support cup mounted on one terminal cap and containing an indicator button disposed telescopingly in the cup with an outer hermetically closed end. A spring inside the button biases the outer end face away from the support cup. The outer end of the button is held in place by a fusible indicator wire.

The button is a bellows with the inner end hermetically sealed to the bottom of the support cup to isolate the fusible indicator wire from ambient gas.

3 Claims, 2 Drawing Figures

ELECTRIC FUSE WITH SEALED INDICATOR

BACKGROUND OF THE INVENTION

The present invention relates generally to electrical fuses having means for indicating a fused condition, and relates particularly to current-limiting power fuses with such indicating means.

Current-limiting power fuses generally have a cylindrical housing of insulating material which is closed at each end by a metal terminal cap. A main fusible element, usually a silver ribbon, extends inside the housing between the terminals. The space around the fuse element is filled with silica sand. When current through the fuse element exceeds the rating of the fuse for a sufficient time, the element melts or fuses at one or more points, with the resulting formation of arcs there. The arcs progressively melt the sand and form channels of fulgurite in it. The relatively high resistance fulgurite eventually suppresses any significant flow of current through the fuse.

Because the melting of current-limiting fuses of the type described above is silent and does not normally result in an obvious change in the outward appearance of the fuse, it is common to provide on the fuse an indicating means by which it can be readily determined visually that the fuse has melted, or fused. Such indicating means typically include an insulating support cup mounted to the inside face of one of the terminal caps over an opening in the cap. A cup-shaped, insulating indicator button is situated in a telescoping fashion inside the support cup. A coil spring inside the button away from the bottom of the support cup. The button is held in place against the force of the spring by a fusible restraining wire which passes into the button through a small insulating bushing in the bottom of the support cup, under an attachment tab protruding from the inside top of the button, and out again through the bushing in the bottom of the support cup. The wire is fixed under tension by a tapered pin pressed into the passage in the bushing. The loose wire length extending from the bushing is electrically connected to the immediate terminal cap, while the other length extends through the silica sand in the housing to connection at the other terminal cap.

When the main element of the fuse melts, the line voltage appears across the terminal caps. This results in melting of the restraining wire inside the button. The unrestrained button is now pushed out through the opening in the terminal cap by the spring. The protruding portion of the button provides a ready visual indication that the fuse has melted.

Current limiting fuses are sometimes located where they may be exposed to an ambient combustible gas. The melting of the indicator wire under such conditions could cause ignition of the ambient gas by the arcing inside the indicator button and result in an explosion.

SUMMARY OF THE INVENTION

In accordance with the present invention, a novel fuse includes a sealed indicator button in the form of a bellows which can provide the indicating movement of the outer button face while maintaining the interior space of the button hermetically sealed from ambient gas.

DESCRIPTION OF THE PREFERRED EMBODIMENT

Figure 1:
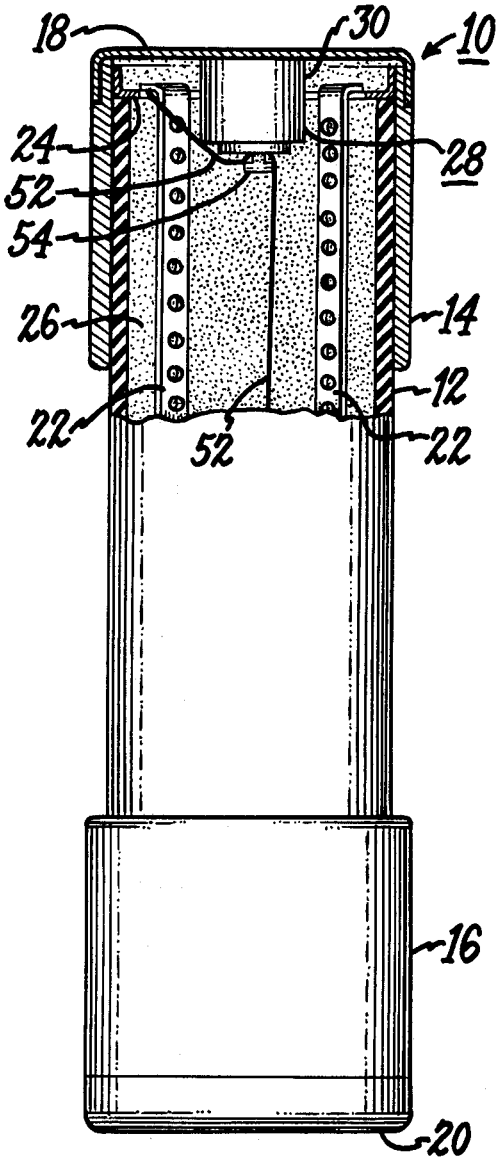
FIG. 1 is a partially sectioned side view of an electrical power fuse provided with an indicating mechanism in accordance with the preferred embodiment of the present invention.

A preferred embodiment of the invention is the motor starter fuse 10 shown in FIG. 1 of the drawings. The fuse 10 includes a tube 12 of fiberglass having an upper copper ferrule 14 at one end and a lower ferrule 16 at the other end. The end openings of the upper and lower ferrules 14, 16 are closed by upper and lower copper end caps 18, 20, respectively. Fusible ribbon conductors 22 of silver, the main fuse elements, are strung under tension between metal spacers 24 and soldered to them. The remaining space around the ribbons 22 inside the tube 12 is filled with an interrupting medium of finely divided quartz sand 26.

Figure 2:
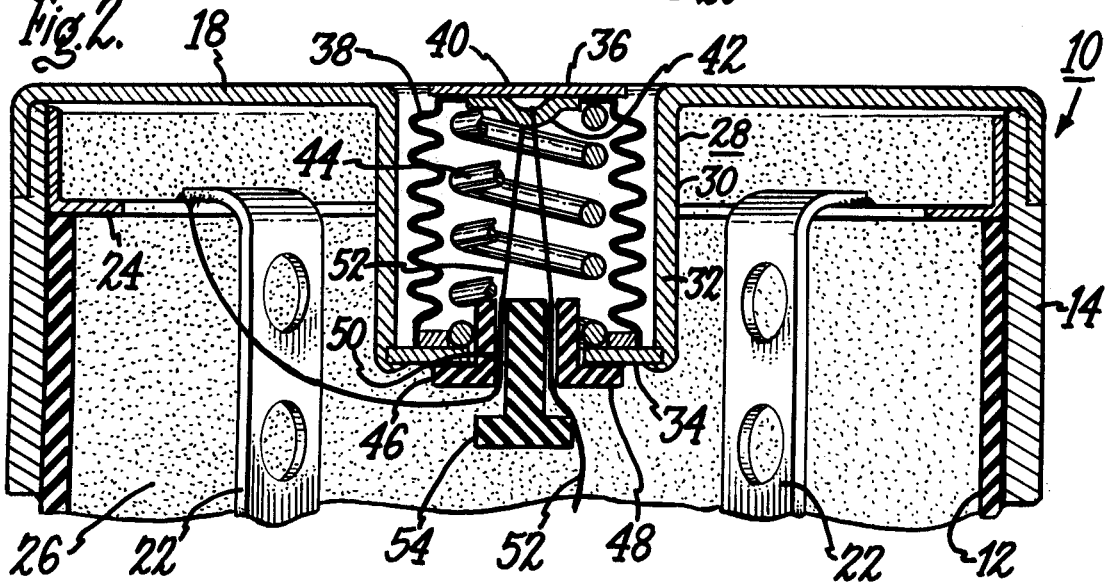
FIG. 2 is an enlarged, sectional side view of an end cap of the fuse of FIG. 1, showing in more detail the indicating mechanism.

To the upper end cap 18 is part of an indicating mechanism 28, shown in greater detail in the FIG. 2. A round metal support cup 30, formed by a short wall section 32 of brass tubing which is upset around a brass washer 34 to form a bottom, is brazed at its open end to the inside surface of a matching opening centrally located in the upper end cap 18. Inside the support cup 30, and oppositely oriented with respect to it, an indicator button 36. The button 36 is a cup-shaped metal bellows 38 an outer closed end face 40 brazed to one end. The button 36 is telescoped inside the support cup 30 with sufficient clearance to permit free upward movement and the inner end soldered to the support cup 30 to form a hermetic seal. A tab 42 attached to the inside central portion of the end face 38 serves as an attachment point for wire.

Inside the button 36 is a stainless steel coil compression spring 44 which exerts a biasing force between the end face 40 of the button 36 and the bottom of the support cup 30. Fitted into a central opening in the washer 34, which forms the bottom of the support cup 30, is an insulating bushing 46 of phenolic resin having a flange 48 which rests on the washer 34 about the perimeter of the opening. A round aperture 50 in the center of the bushing 46 passes through it to the interior of the support cap 30.

A nickel-chromium indicator restraining wire 52 having a diameter of 10 thousandths of an inch and a composition of essentially 80% nickel and 20% chromium, by atomic weight, passes through the bushing aperture 50 into the button 36, is looped over the tab 42 and passes back out again through the aperture 50. The wire 52 is pulled tight against the face of the spring 44 so that the end face 40 is flush with the end cap 18. The wire 52 is fastened to the bushing 46 under tension by the insertion of a plug 54 into the aperture 50. Each of the ends of the wire 52 is soldered to a spacer 24.

When an overload condition is present in the fuse 10, causing the fuse ribbons 22 to melt, the sections of the wire 52 holding the button 36 against the force of the spring 44 also melt, thereby releasing the end face 40 of the button 36 outward so that it protrudes from the end cap 18 to indicate operation of the fuse 10.

While the button 36 of the preferred embodiment is a metal bellows, a resilient bellows of rubber or plastic may also be used, provided that it is sufficiently resistant to chemical attack by the ambient conditions. The fuse 10 having metal bellows is particularly suited for use in a gasoline refinery, where gasoline and other vapors can degrade rubber sealing members.

The biasing force provided by a spring inside the button may also be provided by the resilience of the bellows itself.

I claim:

1. An electric fuse of the type having an insulating housing, electrically conductive terminal caps at opposite ends of the housing, at least one main fusible element inside the housing connecting together electrically the terminal caps, and an indicating mechanism at one of said terminal caps for indicating fusing of the main element, wherein the improvement comprises said indicating mechanism comprising:

an electrically conductive support cup having its rim aligned with, and adjacent, an opening in one of said terminal caps and rigidly fastened in position to said cap in electrical connection thereto;

an apertured insulating bushing plug fitted into an opening in the bottom of said support cup;

a bellows telescopingly disposed inside said support cup, said bellows having a closed end remote from the bottom of said support cup and being sealed hermetically to the bottom of said support cup at the other end to function as a sealed indicator button;

biasing means for forcing the closed end of said button away from the bottom of said support cup, and an electrical resistance restraining wire passing through said aperture in said bushing plut to the inside of said support cup and being secured to the bottom of said button, said wire being also secured under tension at said bushing plug, so that said button is held by said wire against the biasing force of said spring, the portion of said wire on the outside of said support cup passing through the interior of said insulating housing of said fuse and being electrically connected between said terminal caps.

2. The fuse defined in claim 1 and wherein said biasing means is said bellows itself.

3. The fuse defined in claim 1 and wherein said bellows are of metal and are electrically connected to said support cup.

* * * * *